United States Patent [19]

Schleicher

[11] 4,238,272

[45] Dec. 9, 1980

[54] TAPE DISPENSER

[76] Inventor: Ernest E. Schleicher, 2929-82nd Ave., Oakland, Calif. 94605

[21] Appl. No.: 71,533

[22] Filed: Aug. 31, 1979

Related U.S. Application Data

[63] Continuation-in-part of Ser. No. 942,427, Sep. 14, 1978.

[51] Int. Cl.[2] ..... B32B 31/00; B44C 7/00

[52] U.S. Cl. ..... 156/527; 156/577

[58] Field of Search ..... 156/523, 526, 527, 574, 156/577

[56] References Cited

U.S. PATENT DOCUMENTS

| | | | |
|---|---|---|---|
| 2,890,808 | 6/1959 | Seror | 156/577 |
| 3,085,727 | 4/1963 | Waltz | 156/527 |
| 3,351,511 | 11/1967 | Petterson | 156/527 |
| 3,895,059 | 7/1975 | Link | 156/527 |
| 4,096,021 | 6/1978 | Pool | 156/527 |

*Primary Examiner*—Douglas J. Drummond

*Attorney, Agent, or Firm*—Harris Zimmerman; Howard Cohen

[57] ABSTRACT

A device for dispensing adhesive tape directly onto a surface includes a housing comprising a pair of spaced tear-drop shaped panels and a wall joining the peripheral edges thereof. A spool extending between the panels supports a roll of adhesive tape in rotatable fashion, with the free end thereof extending to a slot opening in the apex of the housing. A post extends between the panels medially of the roll and the slot opening. A spring member is secured to the post, one end thereof having a serrated cutting edge and anvil disposed in the slot opening, the other end impinging resiliently on the supply roll to act as a brake thereon.

9 Claims, 4 Drawing Figures

FIG_1
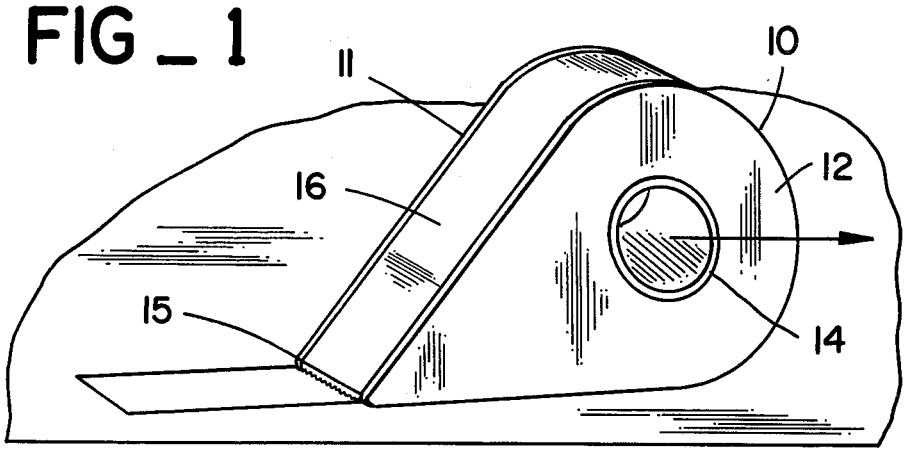
FIG_2
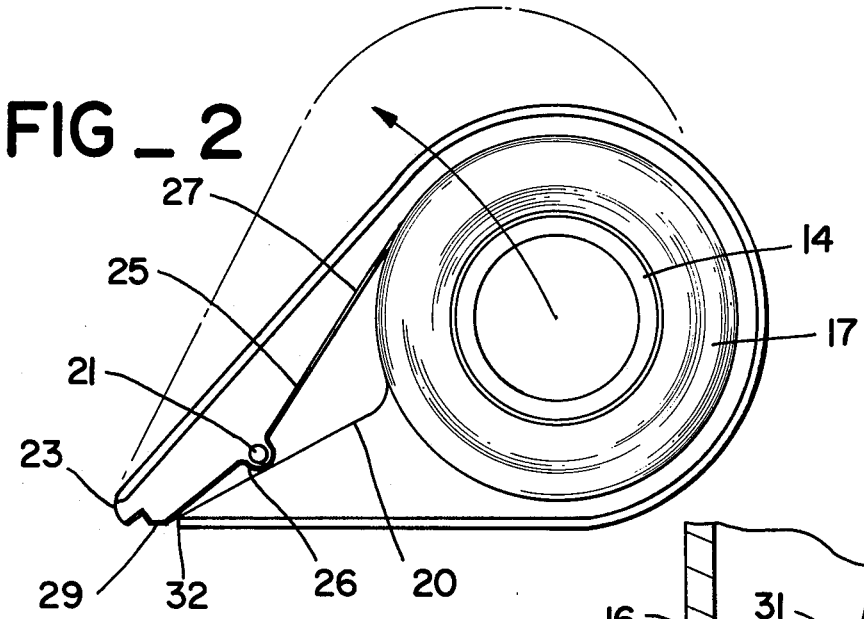
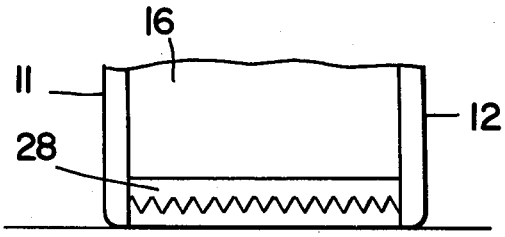
FIG_3
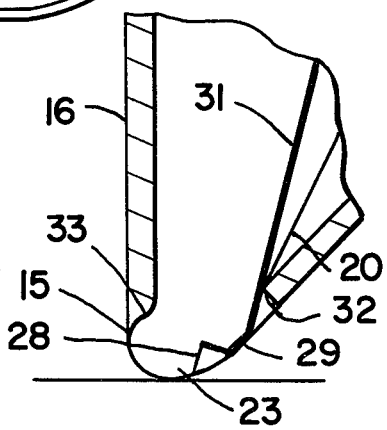
FIG_4

TAPE DISPENSER

REFERENCE TO PRIOR APPLICATION

This application is a continuation-in-part of previously filed application Ser. No. 942,427, filed Sept. 14, 1978, for TAPE DISPENSER.

BACKGROUND OF THE INVENTION

Adhesive tape is used in a diversity of applications, ranging from office and home use to art work and to industrial applications. Generally speaking, the adhesive tape is formed as a spiral wound roll which is secured within a dispensing device.

Prior art dispensing devices for adhesive tape, and in particular self-adhesive tape, generally include a structure having a spool for supporting the tape roll and a cutting edge for severing the applied tape portion from that which remains on the roll. The structure also includes a flat base portion for supporting itself in a stable manner on a flat surface such as a desk, table, or the like.

With these prior art devices, it has been necessary to manually draw a length of adhesive tape from the dispenser, and sever it with the cutting edge. The severed tape piece is then carried manually to the site where it is to be applied. During this procedure there is ample opportunity for the piece of tape to become stuck to the hands of the applier, or to become tangled and become stuck to itself, or to be misaligned or misapplied at the site of application. Further, it may be appreciated that the process of first severing the tape at a remote location and then carrying it to the site of application is a wasteful and inefficient procedure.

SUMMARY OF THE PRESENT INVENTION

The present invention generally comprises a device for dispensing self-adhesive tape directly onto the surface to which it is to be applied. It includes a housing which is specially adapted to be hand-held and manipulated, with a spool therein for supporting a roll of self-adhesive tape. The housing is formed of a pair of spaced apart parallel tear-drop shaped panels which are joined by a wall extending between the peripheral edges thereof. The spool member also extends perpendicularly between medial portions of the tear-drop shaped panels.

Disposed in the wall portion of the housing directly adjacent to the apex thereof is a slot opening through which the tape exits to be dispensed. A post is disposed medially between the slot opening and the supply roll of tape, extending between the opposed panels and supported thereby. A leaf spring member includes a medial portion having a concave recess to receive the post to be retained thereby. One end of the leaf spring member impinges on the supply roll in resilient fashion to exert a braking effect thereon. The other end of the leaf spring member is provided with a serrated cutting edge which is disposed in the slot opening at the apex of the housing. Directly adjacent to the serrated cutting edge is an anvil integrally formed in the leaf spring member.

The serrated cutting edge is recessed slightly from the apex of the housing to prevent scratching or marring of the surface on which the tape is dispensed. In the dispensing position the housing is disposed so that the side wall having the slot opening therein is impinging on the surface receiving the tape. In this disposition the anvil portion of the leaf spring member resiliently impinges on the tape exiting the slot opening, urging the tape onto the surface. To sever the dispensed portion from the portion remaining in the dispenser, the dispenser is rotated upwardly about the apex thereof, which remains in contact with the surface receiving the tape. The angle at which the tape exits the slot opening is thus altered slightly to cause the tape to impinge on the serrated cutting edge. A slight twist of the housing then causes the serrated edge to sever the tape. The tape is severed so that the distal end of the portion remaining in the housing is held at the slot opening by the resilient pinching effect of the anvil against the opening. The subsequent dispensing of tape may be initiated by placing the housing on the surface to receive the tape, the distal tape portion at the slot opening adhering to the surface to self start the dispensing procedure.

A BRIEF DESCRIPTION OF THE DRAWING

FIG. 1 is a perspective view of the tape dispenser of the present invention.

FIG. 2 is a cutaway elevation of the tape dispenser of the present invention.

FIG. 3 is an enlarged end view of the cutting portion of the present invention.

FIG. 4 is an enlarged cutaway side view of the cutting portion of the present invention.

DESCRIPTION OF THE PREFERRED EMBODIMENT

The present invention generally comprises a device for manually dispensing a tape web onto a surface or onto adjoining surfaces. Although the preferred embodiment will be described with reference to self adhesive tape, it may be appreciated that the invention may be used with equal facility to dispense other forms of tape web material. As shown in FIG. 1, the tape dispenser of the present invention includes a housing 11 which is provided with a size and configuration to make it easily hand held and manipulated. The housing 11 includes a pair of generally tear drop shaped panels 12 and 13 which are disposed in parallel, spaced apart relationship. The peripheral edges of the panels 12 and 13 are joined by a generally continuous side wall 16. It may be noted that the housing 11 includes a generally rounded end 10 and an apex end 15, with the wall 16 extending generally tangentially from the apex to the rounded end.

As shown in FIGS. 1 and 2, a generally cylindrical spool 14 extends between the panels 12 and 13, and is disposed centrally within the rounded end 10 of the housing. Secured on the spool 14 is a spiral wound tape web roll 17, shown in FIG. 2. Adjacent to the apex 15 of the housing there is provided a slot opening 23 in the side wall 16. The tape web 20 extends from the supply roll 17 to the slot opening 23 to be dispensed therefrom.

The tape dispenser also includes a post 21 disposed medially between the slot opening 23 and the supply roll 17. The post 21 extends between the panels 11 and 12, and is generally orthogonal thereto.

A salient feature of the present invention is the provision of a leaf spring member 25 secured within the housing. The leaf spring member 25 includes an integrally formed U shaped portion 26 which extends partially about the post 21 to retain the member 25 in place. One end 27 of the member 25 impinges on the supply roll 17 to exert a braking effect on the roll 17. The other end of the leaf spring member 25 is provided with a serrated cutting edge 28, as shown in FIG. 3, extending transversely along the distal edge portion. With reference to FIG. 3, it may be noted that the serrated edge 28 is disposed slightly inwardly of the apices of the panels 11 and 12, so that the sharp points of the cutting edge cannot contact and mar the surface receiving the tape.

Directly adjacent to the serrated edge 28 the member 25 is provided with a trio of integrally formed bends extending transversely therein. The bends form an integral flat anvil 29 and at the same time offset the serrated edge 28 from the nominal plane of the longitudinal extent of the member 25.

It may be appreciated that the member 25 is a leaf spring having an upper arm 27 and a lower arm 31, with the post 21 acting as a pivot about which the arms may flex. The resilient nature of the upper arm 27 exerts a force generally radially inwardly on the supply roll 17, thus supplying a drag force to counter any rotational motion of the roll 17. The lower arm 31 generally impinges on the edge 32 of the slot opening 23. The tape web 20 extending from the supply roll 17 passes between the lower arm 31 and the edge 32 of the opening 23, thus also exerting a drag effect on the tape web 20 as it exits from the opening 23. As shown in FIG. 2, the anvil 29 impinges on the non-adhesive surface of the tape, urging it onto the surface which is to receive the tape. The anvil 29 acts to smooth the tape as it is applied, thereby eliminating puckers, air bubbles, and the like.

When a dispensed tape portion is to be severed from the tape web 20, the housing is rotated upwardly about the apices of the panels 11 and 12, as shown in phantom in FIG. 2, and the tension in the tape web is released. The tape web 20 is thus caused to change its angle of exit from the slot opening 23, and the lower arm 31 returns to its rest position pinching the tape web against the edge 32 of opening 23. The upper spring arm 27 exerts an equal and opposite force on the supply roll 17, due to the pivoting engagement of the spring portion 26 on the post 21. The force exerted on the roll 17 increases the drag thereon and maintains the roll 17 immobile while the cutting process takes place.

As the angle of the housing increases, as shown by the arrow in FIG. 2, the tape web 20 is brought into contact with the serrated edge 28. The serrated edge 28 severs the dispensed portion of the tape from the tape web 20, and the severing process is complete.

It should be noted that as soon as the tension in the web 20 is released, the arm 31 of the member 25 immediately is driven by its own resilient nature to pinch the free end of the tape web 20 against the edge 32 of the slot opening 23, holding the web directly adjacent to the cutting location. A small portion of the tape web, extending from the cut edge of the web to the edge 32 of the opening 23, protrudes from the opening 23 after the web is severed. This protruding end portion of the web 20 acts in a self-starting capacity for the next tape dispensing operation. When the tape dispenser is next placed on a surface, as shown in FIGS. 1 and 2, with the slot opening 23 impinging on the surface, the free edge of the web 20 will be urged onto the surface by the anvil 29, causing the web to adhere to the surface. The housing may then be drawn along the surface with little pressure, as shown by the arrow in FIG. 1, to draw the tape web out of the housing and apply it to the surface. The severing procedure which completes the dispensing process is then accomplished as described in the foregoing description.

I claim:

1. A device for dispensing a tape web from a supply roll onto a surface, comprising;

a housing including a pair of rigid, tear drop shaped panels disposed in parallel, spaced apart relationship;

spool means extending between said panels for supporting said supply roll in rotatable fashion;

said housing including a side wall joining the peripheral edges of said panels, a slot opening in said side wall adjacent to the apices of said panels, said tape web extending from said supply roll through said slot opening;

a post extending between said panels and disposed intermediate of said supply roll and said slot opening; and a leaf spring member secured to said post, one end of said leaf spring member resiliently impinging on said supply roll, the other end extending into said slot opening and resiliently impinging on said tape web.

2. The device of claim 1, wherein said other end of said leaf spring member includes a serrated cutting edge at the distal end thereof.

3. The device of claim 2, wherein said leaf spring member includes an anvil portion for urging said tape web smoothly onto a surface, said anvil portion being integrally formed in said leaf spring member adjacent to said serrated cutting edge.

4. The device of claim 1, wherein said leaf spring member includes a medial concave portion extending partially about and engaging said post.

5. The device of claim 4, wherein said resilient impingement of said leaf spring member on said supply roll and on said tape web are substantially equal and opposite in moment, said post being a pivot for said leaf spring member.

6. The device of claim 2, wherein said slot opening includes a front edge adjacent to said apices, and a rear edge spaced from said front edge and said apices, said other end of said leaf spring member pinching said tape web against said rear edge.

7. The device of claim 6, wherein tension in said tape web applies a counter-moment to said other end of said leaf spring member to urge said other end in flexural movement toward said front edge and relieve said pinching of said tape web.

8. The device of claim 7, wherein said housing is rotatable about said apices to cause said tape web to traverse said cutting edge and be severed.

9. The device of claim 7, wherein release of tension in said tape web relieves said counter-moment in said leaf spring, said other end thereof returning to pinch said tape web against said rear edge of said slot opening.

* * * * *